United States Patent [19]

Armstrong

[11] 3,938,211

[45] Feb. 17, 1976

[54] FLUID LASTING OF SHOES AND SIMILAR OPERATIONS

[76] Inventor: Albert Warner Armstrong, 3136 Perry Ave., Bronx, N.Y. 10467

[22] Filed: Nov. 27, 1974

[21] Appl. No.: 527,743

[52] U.S. Cl. ..... 12/145; 12/1 R

[51] Int. Cl.[2] ..... A43D 21/00

[58] Field of Search ..... 12/1 W, 8.1, 145, 1 R, 12/4.2

[56] References Cited

UNITED STATES PATENTS

| | | | |
|---|---|---|---|
| 1,895,941 | 1/1933 | Ritchey | 12/1 F |
| 3,348,249 | 10/1967 | Markevitch | 12/1 R |
| 3,512,197 | 5/1970 | Carr | 12/1 W |

*Primary Examiner*—Patrick D. Lawson
*Attorney, Agent, or Firm*—Clarence A. O'Brien; Harvey B. Jacobson

[57] ABSTRACT

Apparatus for lasting of shoes has an elastic and flexible pad disposable in a cavity provided in a suitable housing. A portion of the pad is relieved for conforming to the configuration of a shoe last suspended in the housing cavity. Proper relieving of the pad permits same to stretch nonuniformly to conform to the irregular configuration of the last when a substantially uniform fluid pressure is applied to the pad, and this conforming of the pad to the last forces an upper arranged between the pad and last to be wiped over edges of the last and into contact with an insole disposed on the last for facilitating the securing of the upper to the insole.

10 Claims, 5 Drawing Figures

FLUID LASTING OF SHOES AND SIMILAR OPERATIONS

BACKGROUND OF THE INVENTION

1. Field of the Invention

This invention relates generally to the making, or lasting, of shoes, and particularly to method and apparatus for the fluid lasting of shoes and the performance of similar operations.

2. Description of the Prior Art

Lasting is the making of a shoe. All preliminary operations—for example, cutting, stitching or sewing, and the like—are staffed by less skilled operators and scheduled according to the productive capacity of the lasting operation. Further, all subsequent operations—for example, sole and heel spotting, inspection, packing and shipping, and the like—are dependent upon the lasters. Here, as well, the quality of the labor is less skilled and less expensive.

Many of the lower quality or special shoes, such as rubbers, tennis shoes, and the like, are lasted, or formed, by extrusion. But, this method is not suitable to the fabrication of medium and high quality shoes. Consequently, most of the latter mentioned shoes are still lasted primarily by hand. Machines have been developed that will last the toe and/or heel of the shoe, but not the entire shoe. These machines have been helpful in providing uniform quality to partial lasting and provide physical power for partially lasting some materials that cannot be readily managed by hand. In addition, there is a machine, generally referred to as the "Kamborian", that can completely last a shoe in one operation, but the high degree of skill required by the operator renders qualified labor in short supply and prohibitively expensive. In addition, this known machine cannot handle materials that are either too soft or too stiff.

Early in this century, it was recognized that a need existed for better—that is, faster and less expensive—ways to last a shoe. Any solution, naturally, would minimize the physical effort and operator skill required. While the solutions that were formulated tended to minimize the physical effort required, the resulting splitting of the operation into several parts to reduce the skill necessary to do the job only succeeded in increasing costs and, in many cases, created a safety hazard for the operator.

While it was recognized early that it would be desirable to accomplish the lasting operation by use of fluid pressure which would wipe an upper to an insole, attempts to construct devices to last shoes in such a manner proved impractical because of inability to properly control the wiping action of an elastic sheet and the like, acting under fluid pressure. By "to wipe" is meant the operation wherein the peripheral portions of an upper are folded over and secured to an insole, with the upper being, of course, the material that encloses the foot within a shoe. Thus, early attempts to achieve a fluid lasting of shoes, such as shown in, for example, U.S. Pat. Nos. 761,356, issued May 31, 1904 to W. H. Burritt, and 1,261,959, issued Apr. 9, 1918 to R. Reid, leave the wiping of the upper to the insole as a subsequent manual operation.

U.S. Pat. No. 3,422,475, issued Jan. 21, 1969 to H. H. Hart, discloses a lasting arrangement wherein the last is rammed into an elastomeric sheet which supports the upper. In particular, this patent states in column 4, lines 69 through 75, and column 5, lines 1 and 2, that the expansion of an elastomeric sheet about the last, while possible, is undesirable because of inability to control the wiping action of the elastomeric sheet on the last. Thus, the latter mentioned approach is generally not in use, although the advantages of such a technique are widely known in the art.

SUMMARY OF THE INVENTION

It is an object of the present invention to provide improved apparatus for permitting the fluid lasting of shoes in a safe, efficient, and inexpensive manner.

It is another object of the present invention to provide an improved elastic pad capable of conforming to the configuration of a shoe last while wiping an upper about the last.

It is still another object of the present invention to provide a housing for use in the fluid lasting of shoes which is capable of withstanding the high pressures employed in such operations.

It is yet another object of the present invention to provide an improved process for the lasting of shoes by the use of fluid pressure.

These and other objects are achieved according to the present invention by providing a flexible and elastic pad having a relieved portion which conforms to the configuration of an associated shoe last. By "relieved portion" is meant that the pad, which is generally fabricated from a sheet of elastomeric material, of varying thicknesses in certain portions thereof in order to vary the stretch which will occur in certain portions of the pad when the pad is subjected to a substantially uniform fluid pressure.

The relieved pad according to the present invention is advantageously removably arranged in the manner of a diaphragm in the cavity of a housing for dividing the cavity into a pair of chambers. Preferably, the housing is a drum having upper and lower parts, with each of the parts being provided with one of the chambers into which the housing cavity is divided by the pad. The pad is advantageously removably secured between the upper and lower parts at an interface between these parts. The drum is, for reasons of safety, a pressure vessel, with the upper and lower parts releasably locked together in a known manner, and with the upper part being provided with a cover arranged for permitting selective access to the chamber associated with the upper part.

A last pin is advantageously arranged extending into the drum upper part chamber for removably suspending a shoe last in the aforementioned chamber. Further, a last holder is preferably mounted on the cover associated with the drum upper part and is arranged extending into the upper part chamber at, for example, right angles to the last pin for engaging the last and preventing same from movement toward the cover during a lasting operation.

Once a portion of the elastic and flexible pad according to the present invention is relieved in a suitable manner for permitting certain portions of the pad to stretch more than other portions, and the pad and a corresponding last are arranged in the housing adjacent one another, an insole may be attached to the last in a conventional manner, such as by the use of a tack, and the like. Next, an upper of a shoe being lasted may be arranged in the housing cavity between the last and the pad, with an end of the upper being attached to the last, and an equal fluid pressure applied to the pad for causing the pad to surround the last and wipe the upper over the edges of the last adjacent the insole for facilitating securing of the upper to the insole. In this manner, a shoe may be lasted in a single operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
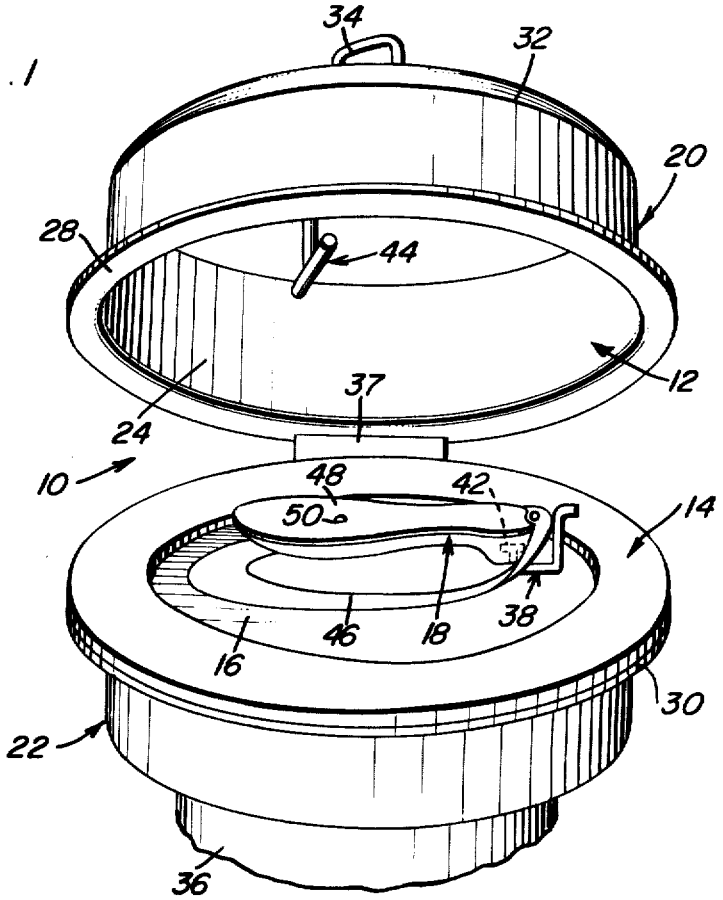
FIG. 1 is a fragmentary, exploded, perspective view showing fluid lasting apparatus according to the present invention with the housing thereof in an open mode.
Figure 2:
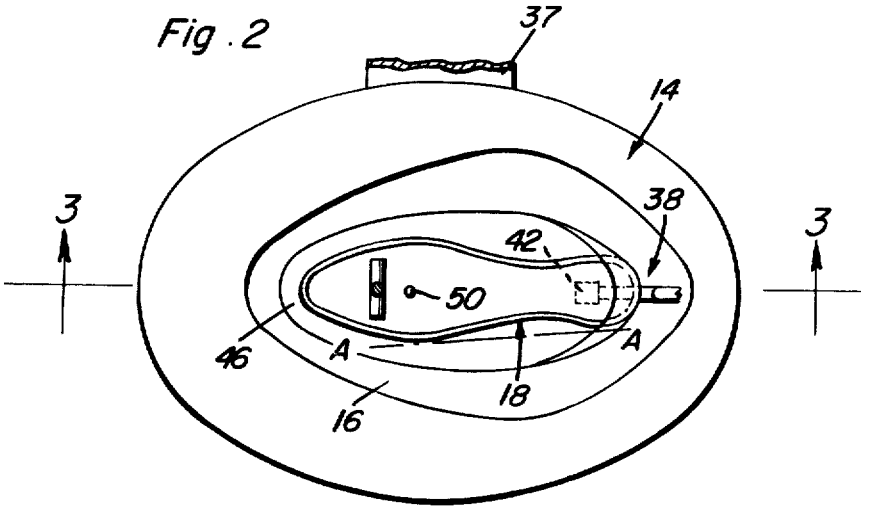
FIG. 2 is a horizontal sectional view taken generally through the joining plane of the housing parts as seen in FIG. 1.

Referring now more particularly to FIGS. 1 and 2 of the drawings, apparatus for lasting of a shoe by fluid pressure includes a housing 10 provided with a cavity 12. An elastic and flexible pad 14 is arranged in cavity 12 in the manner of a diaphragm, with a portion 16 of pad 14 being relieved for conforming to the configuration of a conventional shoe last 18 disposed in housing cavity 12 together with the pad 14. The latter, due to the aforementioned relieved portion 16, is capable of stretching non-uniformly to conform to the irregular configuration of last 18 when fluid pressure is applied to pad 14.

Housing 10 is advantageously the illustrated drum having an upper part 20 and a lower part 22, with each part provided with a chamber 24 and 26, respectively, partially forming housing cavity 12. Chamber 26 may be seen in, for example, FIG. 3 of the drawings. Each part 20, 22 is advantageously provided with an associated flange 28 and 30, respectively, between which is removably secured pad 14. Advantageously, flanges 28, 30 may be selectively locked together, and pad 14 retained between them, by means of conventional bolts (not shown) and associated nuts (not shown), with the bolts passing through sleeved or grommeted holes (not shown) provided both in pad 14 and the flanges 28, 30.

A cover 32 is advantageously formed in the upper portion of part 20, and arranged for permitting selective access to chamber 24 associated with part 20. Cover 32, which may be provided with a handle 34 for facilitating manipulation of the cover, is preferably selectively attached to the lower portion of part 20 by a conventional quick-lock seal (not shown) which is opened and closed manually with the lasting of each shoe. Of course, both the locking arrangement for securing flanges 28 and 30 and the quick-lock seal for retaining cover 32 on the lower portion of part 20, as well as the walls of the parts 20 and 22 themselves, must be capable of withstanding the pressures encountered during the fluid lasting, and as required by various statutes and regulations, in order to provide a sufficient safety factor to assure compliance of the invention with federal and state safety laws, regulations, and codes. This also applies to the pedestal 36 on which lower part 22 is supported, and effectively forms an extension thereof. This pedestal 36 functions to not only support housing 10, but also provides a plenum chamber for passage of fluid against pad 14.

To facilitate manipulation of upper part 20 relative to lower part 22, upper part 20 may be hinged to lower part 22 as by a conventional hinge 37 suitable for the purpose.

A last pin 38, which is advantageously in the form of a metal rod ⅜ to ½ inch in diameter, is mountable in a cooperating recess 40 (FIG. 3) provided in the side wall of the lower portion of upper part 20. While FIGS. 1 and 2 of the drawings show pin 38 separated from the side wall of the lower portion of upper part 20, this was done only for reasons of clarifying these figures. It is to be understood that during normal operation of the lasting apparatus according to the present invention, pin 38 is anchored in the wall defining upper chamber 24 of the drum. Further, last 18 is provided with a standard lasting pinhole in which the free, or outward, end of pin 38 is received. In some instances, it may be advisable to provide at the outermost tip of pin 38 a lock key 42 for securing last 18 against upward force of pad 14. This precaution, however, is advisable only in special cases, because a preferably spring-loaded last holder 44 is attached to cover 32 and arranged extending into chamber 24 for engaging last 18 and preventing last 18 from movement toward cover 32 during a lasting operation.

Pad 14 is relieved by being of unequal thickness. That is, pad 14 is thinned to conform to the configuration of last 18, so that when fluid pressure is applied to lower chamber 26 pad 14 will stretch non-uniformly to conform to the irregular configuration of last 18. The relieved portion 16 of pad 14 is only thin relative to, for example, the outer reaches of pad 14. The relieved portion 16 is, by design, thick enough for strength and durability, however. The outer section or portion of pad 14, also by design, is thicker so as to stretch evenly and to act as a carrier for the relieved portion 16 which stretches unevenly according to the configuration of the last. In this manner, pad 14 will stretch unequally when subjected to an equal pressure in chamber 26 and conform to last 18 for wiping an upper 46 over last 18.

The configuration of relieved portion 16 is directly proportional to the amount of stretch required. The broken line A—A in FIG. 2 of the drawings represents the line of resistance to stretch when pad 14 rises under pressure from below and lifts upper 46 up and over last 18 and secures it to innersole 48. The heel and the ball of the foot, as represented by last 18 in FIG. 2, form the straight line of resistance A—A to wrapping or wiping the upper 46 over last 18. The relieved portion 16 of pad 14 opposite the shank, or narrow part of the foot, must be extended to approximately twice the distance as that required around the ball and heel of the foot so that the shank area can be covered by upper 46. In short, given equal pressure on an elastic pad 14, greater or unequal stretch can be obtained by thinning the pad where the additional stretch is desired. It is this principle that makes the present invention unique above all others and permits the complete lasting of a shoe in a single operation by fluid means; something that preceding inventions have failed to do.

OPERATION

At the beginning of a lasting cycle, pad 14, having been previously relieved in a suitable manner, is put in place securely anchored between parts 20 and 22 of housing 10. Cover 32 is opened, and a shoe upper 46, previously closed, or sewn, at the back seam thereof, is dropped over last pin 38 and spread out evenly in the relieved portion 16 of pad 14.

Figure 3:
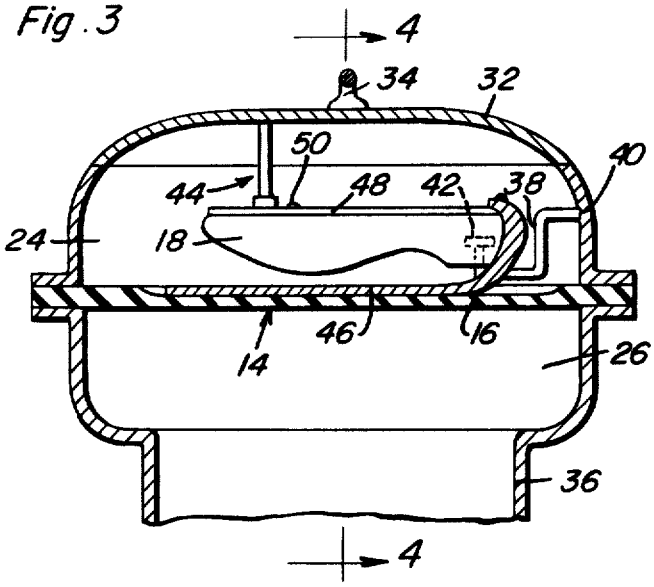
FIG. 3 is a fragmentary, sectional view taken generally along the line 3—3 of FIG. 2.

A last 18, with a latex, or similar tacky adhesive, cemented insole 48 attached, commonly by means of tack 50, matching upper 46 already in place, is positioned on last pin 38 in the conventional manner. Upper 46 is lifted from a resting position and the seam of the heel is hand spotted, or placed in its proper position, on the center of the heel of last 18 at the proper lasting allowance. The latter is the amount of upper portion, determined by the pattern, that is pulled over last 18 and secured to innersole 48; and is usually one half an inch. This positioning is illustrated in FIG. 3 of the drawings. Cover 32 is then closed and the holder 44 positions itself on innersole 48 over last 18, and holds both the innersole and last in place.

Figure 4:
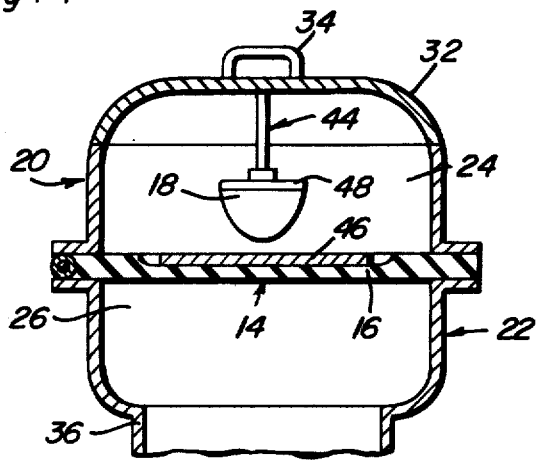
FIG. 4 is a fragmentary, sectional view taken generally along the line 4—4 of FIG. 3.
Figure 5:
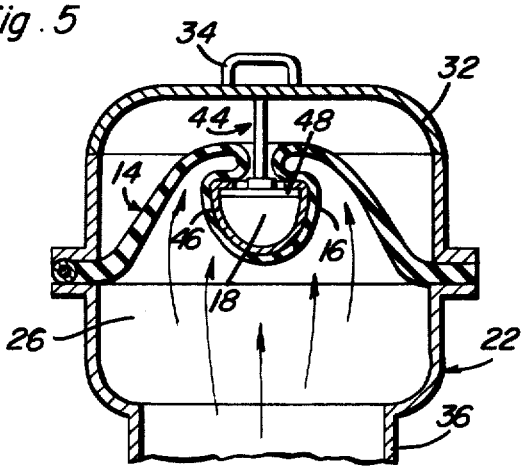
FIG. 5 is a fragmentary, sectional view similar to FIG. 4, but showing a different stage in a lasting operation.

A valve (not shown) is now opened, admitting a fluid, either a gas or liquid, under pressure into the lower chamber 26 of housing 10. As the pressure increases, pad 14 lifts to surround last 18, carrying the upper 46 with it. As the upper 46 is folded, or wiped, over the edges of last 18, it is secured to innersole 48 by means of the latex, or equivalent, adhesive. FIG. 4 shows, in schematic form, the arrangement of the various elements just before pressure is applied to pad 14, while FIG. 5 is the same view after pressure is applied to the pad. The fluid pressure is advantageously vertical, as indicated by the flow arrows in FIG. 5.

After a predetermined time interval, the pressure in chamber 26 is released and pad 14 returns to its rest, or FIG. 4, position. During the forming, or lasting, operation, the fluid, usually air, in the upper chamber 24 is pumped out in a manner not illustrated, creating a partial vacuum in chamber 24 so as not to restrict the free and natural flow of the relieved portion 16 of pad 14 to the position shown in FIG. 5 wherein the portion 16 substantially conforms to the configuration of last 18. Pressure escape valves (not shown) are also included in the sides and rear of upper part 20 to dampen the explosive effects of occasional rupturing of pad 14 and to protect a machine operator (not shown).

As can be appreciated from the above description and from the drawings, fluid lasting apparatus according to the present invention provides:

1. A safe and reliable method for the complete lasting of shoes in one operation by mechanical means. No prior devices have succeeded in accomplishing this desirable operation.
2. More uniform quality in lasting. Machine operations are always more uniform than manual operations.
3. Lower cost. Fluid lasting is the fastest method known.
4. Simplicity of operation. An operator can be trained in, for example, 15 minutes. The physical strength and high skill factors, commonly encountered, are thus eliminated.
5. versatility. Any formable material can be used with the "relieved" pad technique according to the present invention.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. Apparatus for lasting of a shoe, comprising, in combination:

a. a housing provided with a cavity; and b. an elastic and flexible pad arranged in the cavity, a portion of the pad associated with the shank area of the last being relieved for conforming to the configuration of a shoe last arrangeable in the housing cavity, the pad stretching non-uniformly to conform to the irregular configuration of the last, including the shank area, when fluid pressure is applied to the pad.

2. A structure as defined in claim 1, wherein the housing is a drum having upper and lower parts, each of the parts provided with a chamber partially forming the housing cavity, the pad being removably secured between the parts, the drum being a pressure vessel, with the upper part being provided with a cover arranged for permitting selective access to the chamber associated with the upper part.

3. A structure as defined in claim 2, wherein a pin is arranged extending into the drum upper part chamber for removably suspending the last in the upper part chamber, and a last holder mounted on the cover and arranged extending into the upper part chamber for engaging the last and preventing the last from movement toward the cover during a lasting operation.

4. A structure as defined in claim 3, wherein the pad is relieved by being of unequal thickness, the thickness being varied for permitting the pad to stretch unequally when subjected to an equal pressure and conform to the last for wiping an upper over the last.

5. A structure as defined in claim 4, further including the last in combination with the housing and pad, the last removably mounted on the pin and arranged engaging the last holder.

6. A structure as defined in claim 1, wherein the pad is relieved by being of unequal thickness, the thickness being varied for permitting the pad to stretch unequally when subjected to an equal pressure and conform to the last for wiping an upper over the last.

7. A structure as defined in claim 6, further including the last in combination with the housing and pad.

8. A structure as defined in claim 1, further including the last in combination with the housing and pad.

9. An elastic and flexible pad for use in the fluid lasting of shoes in a sealed housing, the pad comprising a relieved portion corresponding to the shank of a foot for conforming to the configuration of the shank area of a last disposed in the housing cavity, the pad stretching non-uniformly to conform to the irregular configuration of the last, including the shank area, when fluid pressure is applied to the pad, the pad being relieved by being of unequal thickness, the thickness being varied for permitting the pad to stretch unequally when subjected to an equal pressure and conform to the last.

10. A method for lasting shoes, comprising the steps of:

a. relieving a portion of an elastic and flexible pad for permitting certain portions of the pad to stretch more than other portions;

b. placing a last adjacent the pad, with the shank area of the last associated with the relieved portion of the pad;

c. attaching an insole to the last;

d. arranging an upper of a shoe between the last and the pad;

e. applying an equal pressure to the pad and causing the pad to surround the last and wipe the upper over edges of the last and into contact with the insole; and f. securing the upper to the insole while the upper is being wiped over the edges of the last.

* * * * *